United States Patent [19]

Friedheim

[11] 4,414,037

[45] Nov. 8, 1983

[54] STEAM JET CLEANING AND STERILIZING SYSTEM

[76] Inventor: Max Friedheim, 8652 LeBerthon St., Sunland, Calif. 91046

[21] Appl. No.: 336,777

[22] Filed: Jan. 4, 1982

Related U.S. Application Data

[63] Continuation-in-part of Ser. No. 144,654, Apr. 28, 1980, abandoned.

[51] Int. Cl.[3] ..... B08B 3/02

[52] U.S. Cl. ..... 134/35; 134/37; 219/272; 219/273; 219/275; 239/13; 239/136; 122/40; 422/305

[58] Field of Search ..... 134/35, 36, 37; 239/13, 239/136; 219/271, 272, 273, 275; 122/40; 38/77.83; 422/305

[56] References Cited

U.S. PATENT DOCUMENTS

| | | | |
|---|---|---|---|
| 2,505,656 | 4/1950 | Wagner | 219/273 |
| 2,753,212 | 7/1956 | Aultman | 122/40 UX |
| 2,861,838 | 11/1958 | Wyatt et al. | 219/273 X |
| 2,983,450 | 5/1961 | Norris et al. | 219/273 X |
| 3,039,454 | 6/1962 | Gilbertson et al. | 239/136 X |
| 3,218,741 | 11/1965 | Martin | 122/40 X |
| 3,718,805 | 2/1973 | Posey | 219/273 X |
| 3,721,802 | 3/1973 | Chrisman | 219/273 |

*Primary Examiner*—Richard V. Fisher
*Attorney, Agent, or Firm*—Herzig & Walsh, Inc.

[57] ABSTRACT

A system utilizing a dry steam jet for cleaning, sterilizing and related purposes. A steam generator in the form of a flash boiler with a heat source is utilized. A reservoir containing a mixture of water and containing a cleaning agent or other chemical is provided. A motor driven reciprocating pump, pumps the liquid mixture into the flash boiler. The mixture immediately is vaporized and then is discharged through the jet nozzle. The system is coordinated to be operated electrically under manual control. The flash boiler is internally etched in a non-uniform manner to enhance the flashing of the liquid. The pump speed, water flow, etched boiler size, and applied heating temperature are coordinated to achieve the result that a steady flow at the desired pressure and temperature from the jet nozzle can be had.

10 Claims, 6 Drawing Figures

STEAM JET CLEANING AND STERILIZING SYSTEM

This application is a continuation in part of Ser. No. 06/144,654, filed 04/28/80, now abandoned.

BACKGROUND OF THE INVENTION

1. Field of the invention

The field of the invention is that of steam or vapor type cleaning devices wherein the steam and/or vapor is discharged from a jet to effect cleaning and drying. The device has utility in many different areas as described in detail hereinafter.

2. Description of the Prior Art

Prior art patents include Nos. 879,055; 1,431,031; 2,501,443; 2,998,924; 3,039,454; 3,229,409; 3,619,559; 3,775,589; 3,811,414; 3,851,146; as well as U.S. Pat. Nos. 3,436,852 and 3,508,354 owned by the inventor herein. These patents show a system wherein a steam generator provides steam for a steam iron. A water reservoir is provided with a solenoid operated pump for pumping water into a steam generator from which the steam is delivered to the iron. The systems of these patents are not constructed for jet cleaning and/or sterilizing.

SUMMARY OF THE INVENTION

The invention is a unitary system which, under manual control, provides vaporized liquid to a jet for purposes of cleaning and/or sterilizing. The liquid that is vaporized may be distilled water or it may be a mixture of water and a chemical cleaning agent or a detergent or disinfectant. The vapor generator is an internally etched flash boiler type that is electrically heated. The liquid to be vaporized is pumped into the generator, by means of a rotary motor operated pump. Electrical controls and indicator lights are provided. The entire system is unitary and integrated and preferably portable, a push button switch being provided for operation of the pump to provide the controlled stream of vapor from the jet, at desired pressure and temperature.

The liquid used may be 100% undiluted water or distilled water or solutions. Different qualities of water may be used such as tap water, filtered water, mineral water, spring water, deionized water, and distilled water. The water may be combined or mixed with various components such as degreasers, solvents, brighteners, oxidizers, penetrants, humectants, vaporizers, detergents, wetting agents, bleaches, rust removers, rust inhibitors, neutralizers, dissolvents, deodorizers, odorizers, germicides, or anticeptics. The system has a wide range of utility for various types of service such as for example in dental laboratories; in connection with watch and clock movements; in connection with metal plating; in manufacture of electronics components; in connection with photo engraving and printing; in lapidary and stone cutting activity; in removing labels and decals, wallpapers, etc.; in dry-cleaning; in sanitizing and sterilizing silverware instruments; in optical and optometric laboratory and office work; and in the field of subminiature instrument manufacture and repair; in the jewelry industry; and in dental operating rooms, medical operating rooms, and in biological and analytical laboratories.

The apparatus is especially useful in the cleaning of weapons and other military equipment and paraphernalia. Presently known methods of cleaning are more expensive, cumbersome, time consuming and uneconomical.

The objective is to provide a machine which will provide a steady stream of high pressure steam in the 80 to 100 PSI range upon demand and a flow time of between 45 to 60 seconds continuous.

A further objective is to be able to remove dirt and foreign matter from surfaces to be cleaned including such tenaciously clinging matter as powder flash and lead particles which occur in fire arms after use. Also as an example, to sterilize a surface by forceful removal of the surface contaminanants, such as bacteria, germs, etc.

To be able to do this, the steamer apparatus has to be able to generate at sufficient force and to be able to maintain or sustain this force long enough to do the cleaning. Testing has indicated a required time of 20 to 30 seconds at the 80 to 100 PSI for most cleaning. The herein steamer can sustain the jet stream for 45 to 60 seconds at pressures between 80 to 100 PSI.

To operate the steamer, it is filled with the appropriate liquid from the top filler tube to the tank or reservoir of the steamer. The liquid enters into the reservoir, which may have a total capacity of slightly over one gallon. On the front of the unit is the on/off switch and when this is activated it commences to heat a CALROD heater operating at 115 or 220 volts, 1500 watts, which is embedded into the base of the generator. This heater heats to the prescribed temperature in about 7 minutes. When this occurs the one of the two signal lights goes off indicating that proper temperature had been reached within the chamber which is 550 F., in the preferred set-up.

The upper of the two lights remains on to indicate that the machine is plugged in and drawing current. The fuse is located on the front panel.

To actually create steam, the steamer activating switch is located on top of the unit and when this switch is turned on it activates the geared motor operating on 115 or 220 volts which in turn operates the pump which pumps a metered amount of liquid into the super heated chamber exploding (flashing) this liquid and creating the steam. In order to provide the proper PSI and time requirements, there is a correlation between the RPM of the motor, the size of the pump and the temperature of the chamber, as described more in detail hereinafter.

A sensitive part which is a cam is positioned between the motor shaft and the pump actuating arm. This cam is set precisely to maintain the pump producing at the rate of 4.9 gallons per hour, in the ememplary embodiment.

The motor RPM is set at 366 RPM by way of preferred example, using dimensions shown, producing a rate of 4.9 gallons of liquid per hour at a chamber temperatures of 550° F.

Failure of correct, coordinated speed or less water being pumped through creates an intermittant burst of steam and is not effective. Excess speed or water flowing into the chamber would only flood the chamber, and is ineffective. The superheated chamber or generator is made in two parts of cast aluminum, each a cylinder the bottom half contains the CALROD heater operating at 115 or 220 volts, 1500 watts.

After casting, the inside of the generator parts are wire brushed and thoroughly cleaned, then the chambers are internally chemically etched with a caustic material. The generator halves are filled with the caustic material and allowed to remain so over night, at least 8 hours. Sufficient time is required to thoroughly etch and as deep as possible, for it is this surface which enables the liquid to explode (flash) upon contact when pumped into the chamber creating the high pressure of about 100 PSI. It is this explosive reaction which creates the pressure needed to clean. The steam build up exits the discharge tube which is 3/16" ID and finally exits; the nozzle which is 3/32" creates restrictions in the line and holding up the PSI to 80.

Upon completion of the etching the two halves are welded together creating the steam chamber or steam generator.

The temperature is controlled by a thermostat located and attached to the underside of the steam generator and pre-set to 550 F. To prevent the thermostat from arcing and freezing together at the points, a spark suppressor is provided in the electrical system which absorbs any potential arcing. Should the spark suppressor and the termostat fail, which would cause the generator to overheat and self destruct, there is built into the system and located on the generator platform directly under the generator a thermal fuse pre-set to discharge at 700 F. and break the generator circuit. To enable flexibility in the use of the steamer, there is built into the side cabinet a female oulet to which is attached an optional foot control. This is hooked up in parallel to the steam activating switch so either the foot or hand switch can activate the machine.

In the light of the foregoing, a primary object is to provide apparatus for generating a stream of dry vapor is provided under manual control, under steady conditions and at desired temperature and pressure.

A further object is to provide a system or device as described wherein liquid of the type identified is pumped into a vapor generator for flash vaporization and delivery to a jet at predetermined pressure, temperature, and time intervals, a manual pushbutton control being provided to bring about the operation.

Further objects and additional advantages of the invention will become apparent from the following drawings and detailed description.

DESCRIPTION OF THE PREFERRED EMBODIMENT AND BEST MODE OF PRACTICE

Figure 1:
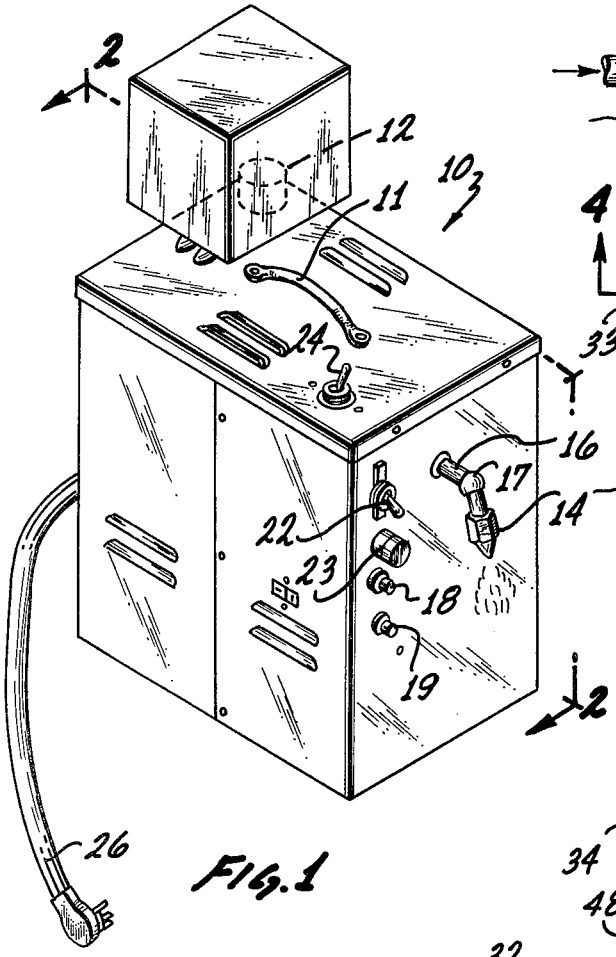
FIG. 1 is an isometric view of a preferred form of the device of the invention.

Referring to FIG. 1, numeral 10 designates the preferred form of the system or device embodied in a rectangular housing or container which may be made of metal or other material. The container has ventillating louvers as shown and a carrying handle 11. Numeral 12 designates the end of the liquid filler pipe. The jet nozzle is designated at 14 and is connected to discharge tube 16 by nozzle joint 17. Numerals 18 and 19 designate indicator lights. Numeral 22 designates a manual switch which controls the system and numeral 24 designates the switch which controls the ejection of steam or vapor from the nozzle. Numeral 26 designates an electrical cable whereby power is supplied to the unit. Numeral 23 designates a removable line fuse holder.

Figure 2:
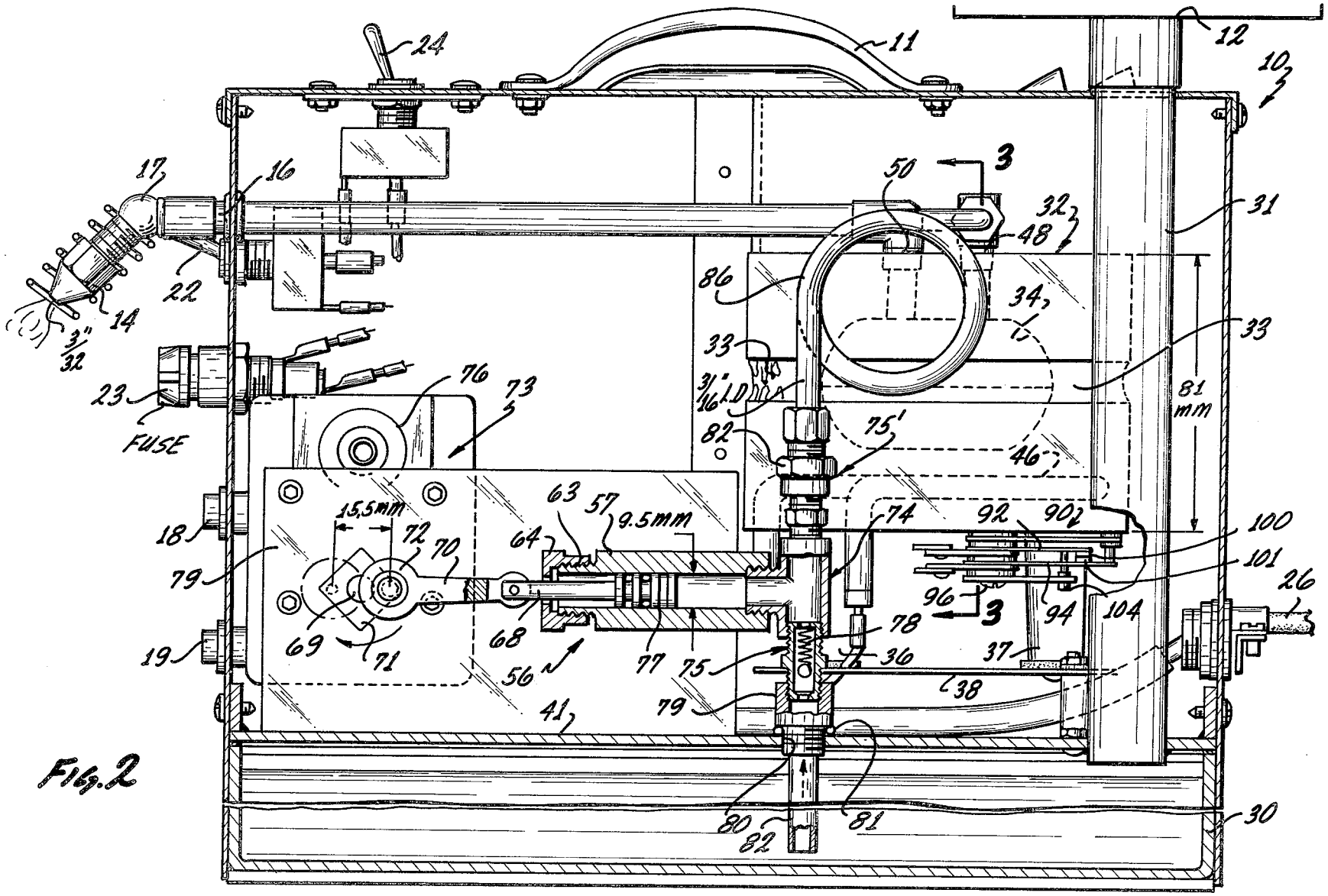
FIG. 2 is a side view, partly in section of the device of FIG. 1.

FIG. 2 shows the system in cross section. At the lower part of the housing there is a liquid tank or reservoir as designated at 30 which contains the water or mixture of water with other components as identified in the foregoing. Numeral 31 is a filler pipe, at the upper end of which is the end cap 12.

Figure 3:
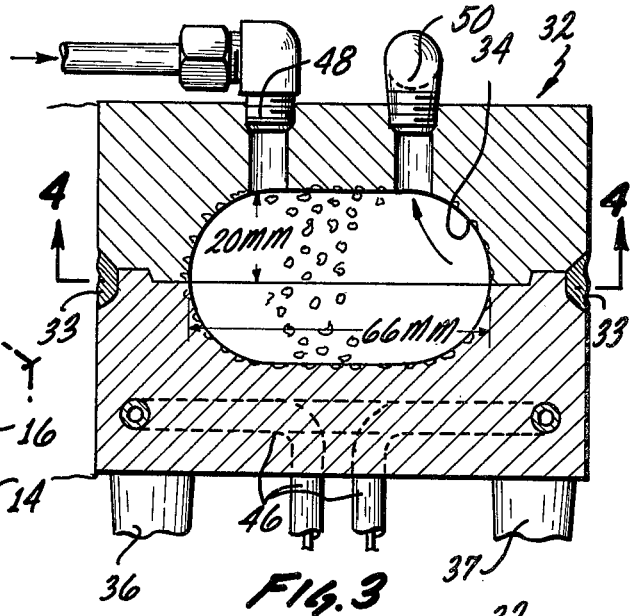
FIG. 3 is a cross-sectional schematic view of the generator taken along line 3—3 of FIG. 2.
Figure 5:
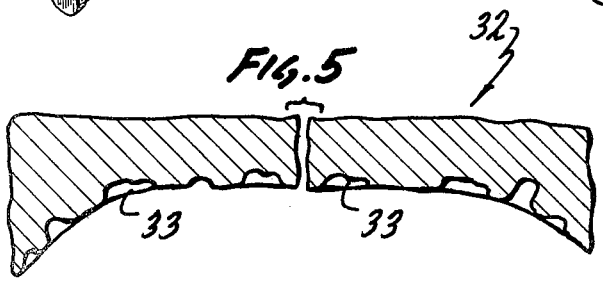
FIG. 5 is a detail sectional view taken along line 5—5 of FIG. 4.
Figure 4:
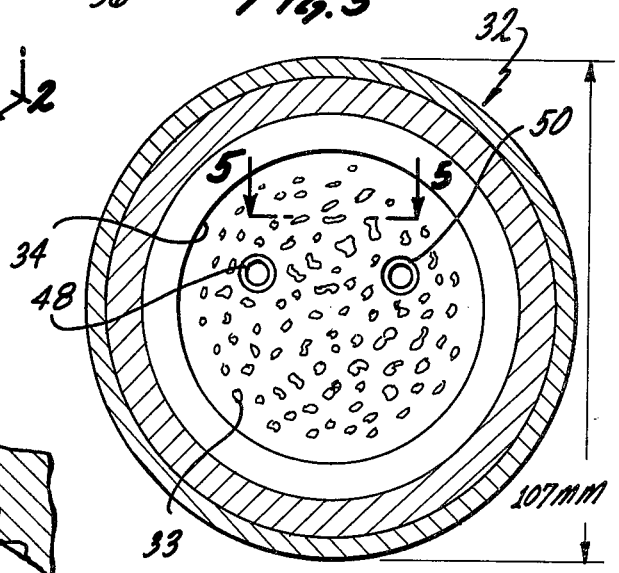
FIG. 4 is a view in cross section of the steam generator, taken along line 4—4 of FIG. 3.

Numeral 32 designates the vapor generator or flash boiler which is shown more in detail in FIGS. 3 and 4. It is essentially in the form of metal castings in two parts and welded together as shown in FIG. 3 at 33 having a shape as shown having an integral opening as designated at 34 in the figures. As may be seen in FIG. 3 it is supported on legs 36 and 37 from a base plate 38 which in turn is supported on support legs or members from the top 41 of the liquid tank 30. The dimensions appearing on the drawing reflect a specific example of a preferred form of the invention. The castings are internally etched, as described to facilitate flashing. See FIG. 4 and the enlarged section FIG. 5.

Referring to the etching 33 of the generator, the final etch is non-uniform in size and produces cavities that range in size from pinpoint to $\frac{1}{8}$" diameter and depths ranging from 1/32" to shallow. Non-uniformity of the etched surfaces within the chamber is crucial for the successful operation of the steam generator. Liquid on contact with 550 F. aluminum surfaces will roll and ball up but the etched surface, as described herein, causes the liquid to explode (flash) instead and this is what enables it to create both the steam pressure and the continuing flow.

Numeral 46 designates a coiled electrical heater which is embedded in the casting, and this heater may be of a CALROD type made by Chromolax. Electrical power is supplied as will be described. Numeral 48 designates the liquid inlet pipe to the generator 32. Numeral 50 designates the vapor outlet pipe.

Numeral 56 designates the plunger pump. It has a cylinder 57. At the end of the cylinder 57 is a connecting nipple 63 threaded into a fitting 64.

Within the cylinder 57 is a piston 77 on a stem 68 which extends to a connecting link 70 having a rotary member 72. Electric gear motor 76 in housing 73 is supported on bracket 79. Numeral 71 designates a square cam on shaft 69 that rotates on a self lubricating arbor sleeve in member 72 to reciprocate the piston 77. The dimensions given are for the specific example.

Numeral 74 designates a T-fitting connected to the cylinder outlet and which contains outlet check valve 75 having closing spring 78.

Numeral 82 designates a disconnectable fitting or coupling providing communication through a port of check valve 75, the fitting being connected to a coiled tube 86 that connects to the inlet pipe 48 leading to the inside of the vapor generator 32.

Valve 75 is coupled to fitting 79 having threaded bore 80 secured to tank top 41 and sealed by O-ring 81, the fitting having inlet tube 82.

Figure 6:
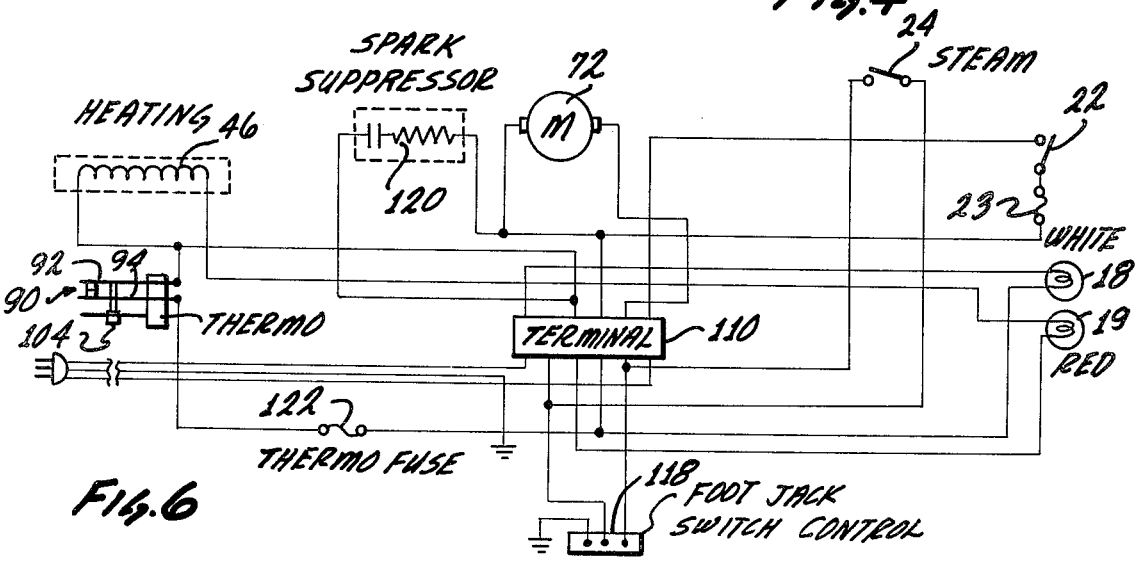
FIG. 6 is a simplified circuit diagram.

The electrical circuit is shown in simplified form in FIG. 6. Numeral 90 designates a thermostat which may be in the form of a thermistor located at the bottom of the generator 32 for controlling the temperature in it. See FIG. 2.

The thermostat includes blades 92 and 94 mounted from a standard attached to the bottom of the generator by screw 96, electrical connections being made to contact members attached by way of the screw 96. The contacts are shown at 100 and 101. The setting of the thermostat can be adjusted by an adjusting screw 104.

The preferred circuitry is shown in FIG. 6. Switch 22 turns on the heating element 46 which is under the control of the thermostat 90. The white light 18 is on whenever the power is on and the red light 19 is on whenever the heater is energized for steaming. The steaming switch 24 turns on the driving motor 72. The motor can also be turned on by the foot switch control 118.

To prevent the thermostat from arcing and freezing together at the points there is provided the spark suppressor 120 in the electrical system and it absorbs any potential arcing. Should the spark suppressor and the thermostat fail, which could cause the generator to overheat and destroy itself, there is built into the system and located on the generator platform directly under the generator thermal fuse 122 pre-set to discharge at 700° F. and to break the generator circuit. See FIG. 6.

To provide flexibility in the use of the apparatus there is built into the side cabinet a female outlet to which is attached an optional foot control 118 which is hooked up on parallel to the steam activating switch so that either foot or hand can activate the apparatus.

The following is a summary of the specifications and/or parameters of a form of the invention that has been reduced to practice producing the dry operating condition as described in the foregoing.

The CALROD heater—1500 watts
Generator temperature—550° F.
Motor RPM—366
Pump delivery rate—4.9 gallons per hour
Discharge tube —3/16 inch ID
Nozzle bore—3/32 inch
Etching, (cavities)—pin point to $\frac{1}{8}$ inch diameter
Cavity depths—1/32 inch to shallow The above specifications identify a specific exemplary embodiment. The specification figures given are subject to limited variation within parameters within which the dry operation can be realized.

OPERATION

The tank is filled with liquid which may be various qualities of water or distilled water or a mixture as already described in the foregoing. The system is turned on by closing the manual switch 22 which controls power to the heater 46 and to the gear motor 76. Energization of signal light 18 indicates that the power is on. Signal light 19 flashes only when the generator is energized. The motor is energized by the push-button switch 24 which is mounted at the top of the unit as shown in proximity to the nozzle 14. When the push-button is operated, the motor, through the lever 72 actuates the stem 68 of the pump 56 so that liquid or whatever the mixture may be be is delivered in a steady stream through the tube 86 and pipe 48 into the cavity 34 in the steam generator. The steam generator acts as a flash boiler, the liquid being instantly vaporized and pressurized so that it is delivered through the tube 86 and pipe 48 into the cavity 34 in the steam generator. The steam generator acts as a flash boiler, the liquid being instantly vaporized and pressurized so that it is delivered through the pipe 50 and tube 16 through the nozzle 14. Since the nozzle is not far removed from the generator, the vapor delivered is dry and serves to clean and disinfect whatever it is directed to. If disinfectant is included in a mixture, the discharge from the jet nozzle immediately sterilizes and the steam or other vaporized liquid blows the surface clean.

The system produces a steady stream in the range of 80 to 100 PSI with a flow time of 45 to 60 seconds continuous. This will accomplish the objectives as set forth in the foregoing.

The CALROD heater operates at 115 or 220 volts, 1500 watts. It heats to the prescribed temperature as given above in about 7 minutes. The red light goes out when the proper temperature has been reached which is 550° F. while the white light remains on to indicate that the machine has power on it and is drawing current.

The motor drives the pump and it pumps a metered amount of liquid into the superheated steam generator where it explodes or flashes the liquid creating the steam. In the preferred form of the invention as described above, the motor is set to operate at 366 RPM and with the dimensions disclosed above, to pump at the rate of 4.9 gallons of liquid per hour.

The steam discharge tube in the preferred form, has an internal diameter of 3/16 inches and the diameter at the exit of the nozzle is 3/32 inches thus, creating a restriction in the line so as to hold the steam within the generator, thus sustaining the pressure.

The cam which the motor drives to actuate the pump is designed to operate to maintain the pump pumping at the rate of 4.9 gallons per hour.

Included in the herein disclosure is a specific example of a preferred form of the invention which has been tested and operates and which has been found to produce highly satisfactory results. The invention is however, not limited to the exact detailed specifications of the preferred example disclosed. Some deviation from the exact specifications of the preferred example will not defeat the purposes of the inventions, but may cause less than optimum performance. The specific example given will readily enable one skilled in the art to practice the invention.

From the foregoing, those skilled in the art will readily understand the nature of the invention and the manner in which it achieves and realizes all of the objectives as set forth in the foregoing. The system is unique and has very high utility and a wide and varied range of applications and uses.

The foregoing disclosure is representative of a preferred form of the invention and is to be interpreted in an illustrative rather than a limiting sense, the invention to be accorded the full scope of the claims appended hereto.

I claim:

1. An apparatus for producing a flow of dry steam at relatively high pressure for cleaning, including in combination, a source of vaporizable liquid medium including a tank adapted to receive water and/or mixtures of water and chemicals, a flash boiler including a solid heat retaining material having a chamber having a controlled heat source embedded in the material for flash vaporizing the liquid medium forced into the vaporizing chamber under pressure, plunger pump means for pumping medium into the boiler, temperature responsive means controlling the heat source whereby the flash boiler is maintained in a superheated state at a temperature of substantially 550° F., the chamber forming a space providing non-uniform internal surfaces within the solid material which space is small relative to the mass of solid material, jet nozzle means connected to said chamber, means whereby the pump means is operated at a predetermined rate to meter flow of liquid into the said chamber, check valve means between the said pump means and the chamber whereby to hold the pressure in the chamber to assure that the chamber operates in a dry condition, and means for correlating the said pump means and said rate of flow to the boiler temperature whereby to produce a flow of dry steam from the jet nozzle at a pressure of 80 to 100 psi for a predetermined number of seconds in the range of 45 to 60 seconds.

2. An apparatus as in claim 1, wherein the said jet nozzle means has a bore on the order of 3/32 inch.

3. An apparatus as in claim 2, wherein the chamber is formed of two parts of cast aluminum welded together providing a cavity between them, the interior of the chamber being etched by way of a pattern of recesses in the internal walls thereof, the recesses being non-uniform cavities ranging in diameter from pin point to 1/8 inch and depths to 1/32 inch, the liquid medium being flashed into steam by contact with said pattern.

4. An apparatus as in claim 2, wherein the pump means is set to produce flow on the order of 4.9 gallons per hour.

5. An apparatus as in claim 1, wherein the pump means is a piston type pump, a gear motor driving the pump whereby the delivery rate of the pump can be metered by varying the motor speed.

6. A method of cleaning and sterilizing, including pumping from a source of vaporizable liquid medium including water and/or mixtures of water and chemicals into a boiler, applying heat to the boiler and maintaining its temperature at a superheating value, metering the flow of liquid from a pump means into the boiler at a predetermined controlled rate relative to the temperature in the boiler, providing non-uniform internal boiler surfaces, discharging dry vapor from the boiler through jet nozzle means connected to it, at a pressure within a predetermined relatively high range, predetermining the size of the orifice in the jet nozzle means to limit discharge of vapor from the boiler, preventing flow of pressure from the boiler back to the pump means whereby pressure and temperature are held within the boiler so that liquid entering the boiler is flashed into steam and the boiler is maintained operating in a dry condition and discharging dry vapor within said pressure range for a predetermined number of seconds.

7. A method as in claim 6, including the steps of controlling the temperature in the boiler to maintain it on the order of 550° F., controlling the pump means whereby to produce a metered flow on the order of 4.9 gallons per hour and providing jet nozzle means having a bore on the order of 3/32 inch whereby the pressure in the boiler is held in the range of 80 to 100 pounds per square inch.

8. A method as in claim 6, including placing check valve means between the boiler and pump means.

9. An apparatus including in combination, a source of vaporizable liquid medium including a tank adapted to receive water and/or mixtures of water and chemicals, a flash boiler having a chamber with non-uniform internal surfaces and having a controlled heat source for flash vaporizing the liquid medium forced into the vaporizing chamber under pressure, plunger pump means for pumping medium into the boiler, temperature responsive means controlling the heat source whereby the flash boiler is maintained in a superheated state, jet nozzle means connected to said chamber, means whereby the pump means is operated at a predetermined rate to meter flow of liquid into the said chamber, and check valve means between the said pump means and the chamber whereby to hold the pressure in the chamber to assure that the chamber operates in a dry condition.

10. An apparatus as in claim 9, including rotary driving means for driving the plunger pump.

* * * * *